US005539853A

United States Patent [19]

Jamaluddin et al.

[11] Patent Number: 5,539,853

[45] Date of Patent: Jul. 23, 1996

[54] DOWNHOLE HEATING SYSTEM WITH SEPARATE WIRING COOLING AND HEATING CHAMBERS AND GAS FLOW THERETHROUGH

[75] Inventors: Abul K. M. Jamaluddin, Pointe-Claire; Sudarshan A. Mehta, Calgary; Robert G. Moore, Cochrane; Robert G. McGuffin, Calgary, all of Canada

[73] Assignee: Noranda, Inc., Toronto, Canada

[21] Appl. No.: 492,334

[22] Filed: Jun. 19, 1995

Related U.S. Application Data

[63] Continuation-in-part of Ser. No. 283,746, Aug. 1, 1994, abandoned.

[51] Int. Cl.[6] ..... E21B 23/00; H05B 3/00

[52] U.S. Cl. ..... 392/302; 166/60

[58] Field of Search ..... 392/301–306, 392/492, 493; 166/60, 61, 302; 165/45

[56] References Cited

U.S. PATENT DOCUMENTS

| | | | |
|---|---|---|---|
| 1,439,340 | 12/1922 | St. Clair, Jr. | 392/492 |
| 1,525,656 | 2/1925 | Redfield | 392/301 |
| 1,681,523 | 8/1928 | Downey et al. | 392/301 |
| 2,632,836 | 3/1953 | Ackley | 392/301 |
| 2,754,912 | 7/1956 | Curson | 392/301 |
| 3,109,912 | 11/1963 | Cerulli | 392/492 |
| 3,163,745 | 12/1964 | Boston | 392/305 |
| 4,285,401 | 8/1981 | Erickson | 166/303 |
| 4,378,846 | 4/1983 | Brock | 166/303 |
| 4,508,172 | 4/1985 | Mims et al. | 166/303 |
| 4,570,715 | 2/1986 | Van Meurs et al. | 166/302 |
| 4,572,299 | 2/1986 | Vanegmond et al. | 166/385 |
| 4,614,392 | 9/1986 | Moore | 339/94 |
| 4,627,490 | 12/1986 | Moore | 166/65.1 |
| 4,694,907 | 9/1987 | Stahl et al. | 166/303 |
| 4,704,514 | 11/1987 | Van Egmond et al. | 392/305 |
| 4,741,386 | 5/1988 | Rappe | 165/45 |
| 4,903,769 | 2/1990 | Hsueh et al. | 166/272 |
| 4,913,236 | 4/1990 | Reed | 166/303 |
| 4,951,748 | 8/1990 | Gill et al. | 166/248 |
| 5,020,596 | 6/1991 | Hemsath | 166/272 |
| 5,058,681 | 10/1991 | Reed | 166/303 |
| 5,060,287 | 10/1991 | Van Egmond | 392/301 |
| 5,065,818 | 11/1991 | Van Egmond | 166/60 |
| 5,070,533 | 12/1991 | Bridges et al. | 392/301 |
| 5,099,918 | 3/1992 | Bridges et al. | 166/60 |
| 5,120,935 | 6/1992 | Nenniger | 392/305 |
| 5,361,845 | 11/1994 | Jamaluddin et al. | 166/302 |
| 5,437,003 | 7/1995 | Blanco | 392/492 |

FOREIGN PATENT DOCUMENTS

| | | |
|---|---|---|
| 2026483 | 4/1991 | Canada . |
| 2021804 | 1/1992 | Canada . |
| 8107866 | 10/1982 | France . |
| 9311337 | 6/1993 | WIPO . |

OTHER PUBLICATIONS

Leshchyshyn, "Post core analysis to determine the steam flow path in the Mcmurray oil sands", Preprint of the CIM/AOSTRA 1991 Technical Conference in Banff, Alberta, Apr. 21–24, 1991.

Bartlett et al., "A new approach to reservoir screening for thermal recovery", *World Oil*, 1991, 48–52 and 101–102.

White et al., "High temperature thermal techniques for stimulating oil recovery", *J. Petro. Tech.*, 1965, 1007–1011.

Rice et al., "A testing of the electric heating process as means of stimulating the productivity of an oil well in Schoonebeek field", Meeting of the Pet. Soc. of CIM, Jun. 7, 1992, pp. 1–16.

Friedman et al., "High temperature sand consolidation", *SPE Production Engineering*, 1988, 167–168.

*Primary Examiner*—John A. Jeffery

*Attorney, Agent, or Firm*—Fitzpatrick, Cella, Harper & Scinto

[57] ABSTRACT

An electric downhole heating system for formation heat treatment in the field of oil and gas production contains a separate wiring chamber, heating chamber, and cooling chamber, the latter being inserted between the wiring chamber and the heating chamber. The heat treatment is carried out by inserting the heater in a borehole to be treated. A gas, preferably nitrogen or air, is brought to the heater with a hose or tube. The gas flows through the wiring chamber and cooling chamber, and is heated by following a tortuous path in the heating chamber before it is expelled from the heater.

9 Claims, 4 Drawing Sheets

DOWNHOLE HEATING SYSTEM WITH SEPARATE WIRING COOLING AND HEATING CHAMBERS AND GAS FLOW THERETHROUGH

FIELD OF THE INVENTION

This application is a continuation-in-part of application Ser. No. 08/283,746 filed Aug. 1, 1994, now abandoned.

The present invention is concerned with a reusable downhole heater for formation heat treatment in the field of porous underground formations containing oil, gas and water.

BACKGROUND OF THE INVENTION

It is not uncommon in the oil producing industry to encounter liquid hydrocarbons which do not flow at a rate sufficient to be of commercial interest. This is generally caused by a high viscosity of the oil at formation temperature. In order to lower the viscosity of such oil, it is a well known technique to increase the temperature of the formation. The reduction of the viscosity of the oil has two important effects. First, it allows the oil to flow easier within the formation and reduces pumping power required to bring it to the surface. Secondly, the reduction in oil viscosity also increases the oil relative mobility and reduces the water relative mobility. The latter effect thus reduces the water production.

Another important application for heat treatment is the prevention or removal of waxes or asphaltenes buildup in the wellbore and near-wellbore region. Other benefits resulting from thermal treatments include clay dehydration, thermal fracturing at high temperatures, prevention of thermal fracturing in water zones at low temperatures and sand consolidation in unconsolidated formations. In water flooding situations, injection well looses its injectivity due to various problems including clay swelling, and therefore thermal treatment can improve the injectivity. In the case of downhole electrical heating, some of the current may be diverted to prevent the corrosion of tubing, casing, pump rods and other downhole components and to prevent buildup of corrosion products.

White et al. in J. Petrol Technol, 1965, 1007 discloses the use of a downhole electric heater to ignite the fuel in situ. The heater is removed and air is supplied to maintain a combustion front. The process managed to improve oil production to four times the precombustion rate while reducing the water cut to 8%. The oil continued to produce at twice the normal rate for several months after the treatment.

U.S. Pat. No. 5,070,533 describes a downhole heater design which uses the casing or tubing as electrodes. One electrode is aligned with the pay zone. The opposite electrode is located outside the pay zone and preferably at least three times the diameter of the hole away from the first electrode. In order to pass from one electrode to the other, the current must pass through the pay zone. The current is carried either by a conductive formation or by the water in the formation. The high resistance to current flow results in localized heating, and the system is preferably operated only while the well is producing. A major problem with this procedure is the potential for accelerated corrosion at the interface of the anode.

U.S. Pat. No. 4,285,401 teaches the combination of a downhole heater with a water pump. If the heater is powered then pressurized water is directed through the heater and to the formation where it will penetrate at the rock formation and thermally stimulate the well If the heater is not activated, then the pressurized water is to turn a turbine and assist in the downhole pumping of production fluids. The use of pressurized water also prevents the heater from overheating and burning out the elements. The method is said to prevent heat losses along the pipe from pumping steam from the surface.

U.S. Pat. No. 4,951,748 is concerned with a technique of heating based on supplying electrical power at the thermal harmonic frequency of the formation. Three-phase AC power is converted to DC and then chopped to single phase AC at the harmonic frequency. The harmonic frequency heating occurs in addition to the normal ohmic heating. The harmonic frequency of the rock or fluid is determined in the laboratory prior to application in the well. This frequency may be adjusted during well heating as the harmonic frequency may fluctuate with temperature and pressure.

U.S. Pat. No. 5,020,596 describes a downhole heating process which begins by flooding the reservoir with water from an injection well to a desired pressure. A fuel-fired downhole radiant heater in the injection well is ignited and heats the formation and water. The heat radiates along the entire length of the heater to keep the isothermal patterns close to vertical and provide a good sweep. The heater consists of three concentric cylindrical tubes. A burner within the innermost tube ignites, and burns a source of fuel and air. Apertures are sized and positioned to develop laminar flow of the combustion products from the burner such that the heat transfer is effective along its entire length. The combustion products are removed from the annular space between the two outer tubes. The design of the heater minimizes local hot spots and should heat the reservoir evenly. The temperature which can be reached in the reservoir is dependent upon the pressure of the reservoir. However, the use of a long radiant heater such as the above implies important losses of heat in an effort to achieve equal flow over the entire height of the reservoir.

U.S. Pat. No. 5,120,935 describes a downhole packed-bed electric heater comprising two electrodes which are displaced from each other. The gap is filled with conductive balls. Resistive heating occurs when current is passed through the heater. The multiple paths of current flow through the heater prevent failure of the heater due to element burnout. The heater provides a large surface area for heating while maintaining a low pressure drop between the inlet and outlet of the heater. The length and diameter can be adjusted to satisfy well design and heating requirements. Formation heating is achieved by passing a solvent through the heater which is heated up, passes into the formation and transfers the heat to the formation.

U.S. Pat. No. 4,694,907 uses a downhole electric heater to convert hot water to steam. Instead of producing steam on the surface and pumping it downhole, it is suggested to heat water on the surface, pump it downhole where an electric heater converts the hot water to steam. The electric heater is a series of U-tubes disposed circumferentially around the water injection tube. Each U-tube can be individually controlled. The injection tube is closed at the bottom with orifices displaced radially. Water flows out the injection tube and past the heater tubes where it is vaporized. Electric power is supplied via a three-phase grounded neutral "Y" system with one end of each heater element being common and neutral. The system also supplied DC current to the heater.

U.S. Pat. No. 5,060,287 is concerned with a copper-nickel alloy core cable for downhole heating. The cable is capable of withstanding temperatures to 1000° C. and utilizing voltages to 1000 volts. The cable is especially useful for heating long intervals. U.S. Pat. No. 5,065,818 describes a heater using this material which is cemented into an uncased borehole. The heater can provide heat to about 250 watts per foot of length.

U.S. Pat. No. 1,681,523 discloses a heater comprising two concentric tubes. The inner tube acts as a conductor and the heating coils are wrapped at various locations along the whole length of the conductor. The other conductor is an insulated cable that runs parallel to the conductor tube all the way to the surface. Both tubes, along with multiple heating elements, are housed in a larger casing. Air is circulated downward through the inner pipe and upward through the annular space between the inner and outer pipes. At the surface, a pump is used to recirculate the air. In this manner, the whole length of the pipe is heated, and the air circulation distributes the heat. The purpose of such heating is to keep the entire production line heated to prevent paraffin deposition. Heated air never comes out of the system. Further, the temperature of heating and the electrical connections, power and temperature requirements are not entertained. Such a heating system is not suitable for hot-fluid injection in a formation, since for such use, an end of the heater must be open. Also, the multiple connections of the heating elements with the conductors will render the heating system inoperable in the presence of formation fluids, for example, like salt water. It is likely that the temperature applied with this system are not particularly high (the melting point of paraffin is lower than 60° C.), since the multiple electrical connections would not sustain prolonged exposure to high temperature.

SUMMARY OF THE INVENTION

In accordance with the present invention, there is now provided a downhole electrical heating system comprising a longitudinal heater with a container having at least one opening at one end and connecting means at the opposite end for connecting the heater to external tubing, the tubing being connected to a source of gas located at the surface, the container comprising:

a wiring chamber adjacent to the connecting means for connecting wires from an electrical power source located at the surface, to at least one heating element converting electrical energy to heat;

a heating chamber comprising the at least one heating element for heating a gas continuously passing through the heating chamber;

a cooling chamber inserted between the heating chamber and the wiring chamber wherein the gas is circulated therein before passing through the heating chamber, for preventing an increase of temperature in the wiring and cooling chambers;

the gas following a tortuous path in the heating chamber before being released outside the heater through the at least one opening of the container.

IN THE DRAWINGS

DETAILED DESCRIPTION OF THE INVENTION

The electric downhole heating system of the present invention is particularly suitable for stimulating the production of oil and gas formations containing clay materials, and is most appropriate for applications such as that describes in application Ser. No. 08/070,812 filed Jun. 3, 1993, now U.S. Pat. No. 5,361,845. Other uses include in situ steam generation, initiating in situ combustion, near-wellbore heating for heavy oil viscosity reduction, stimulation of water injection well, near-wellbore emulsion breakings etc.

The present invention will now he described by referring to the accompanying drawings which illustrate preferred embodiments.

Figure 1:
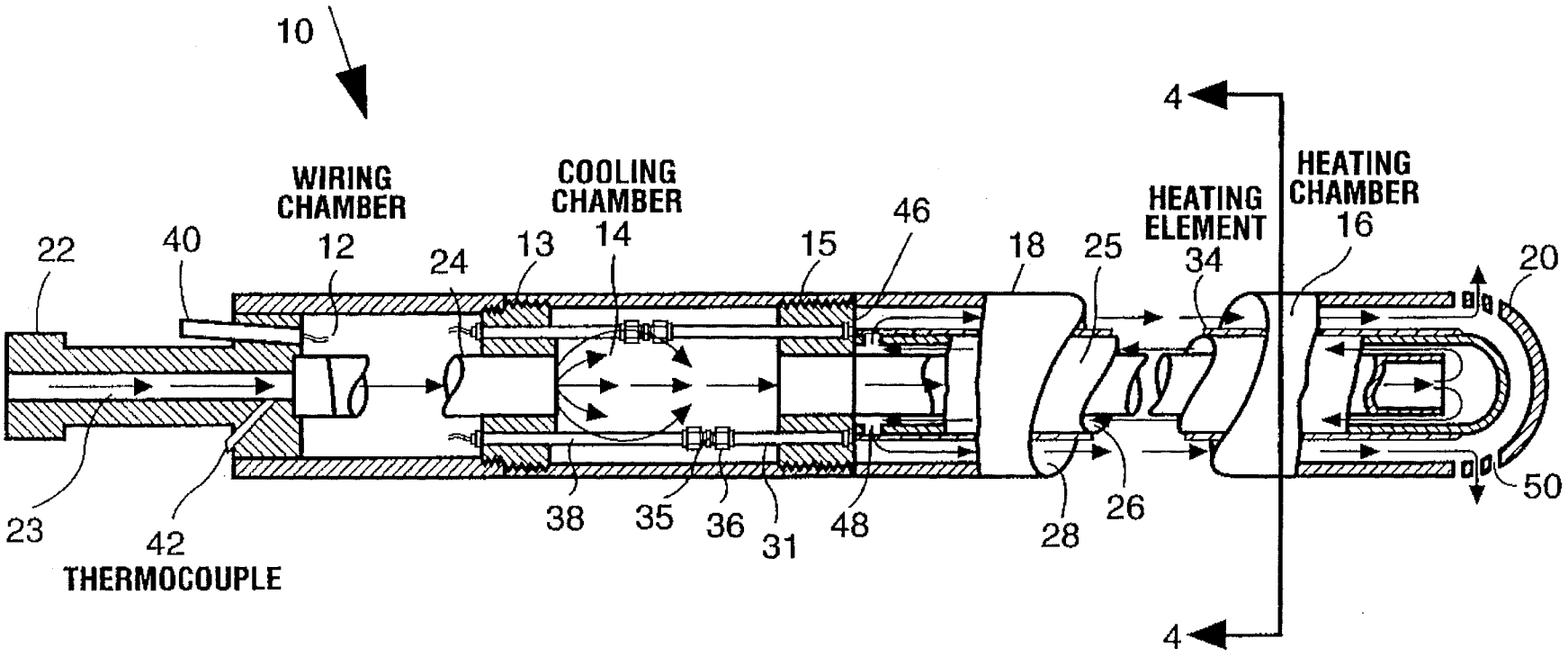
FIG. 1 illustrates a first embodiment of the heater used in the heating system of the present invention.
Figure 2:
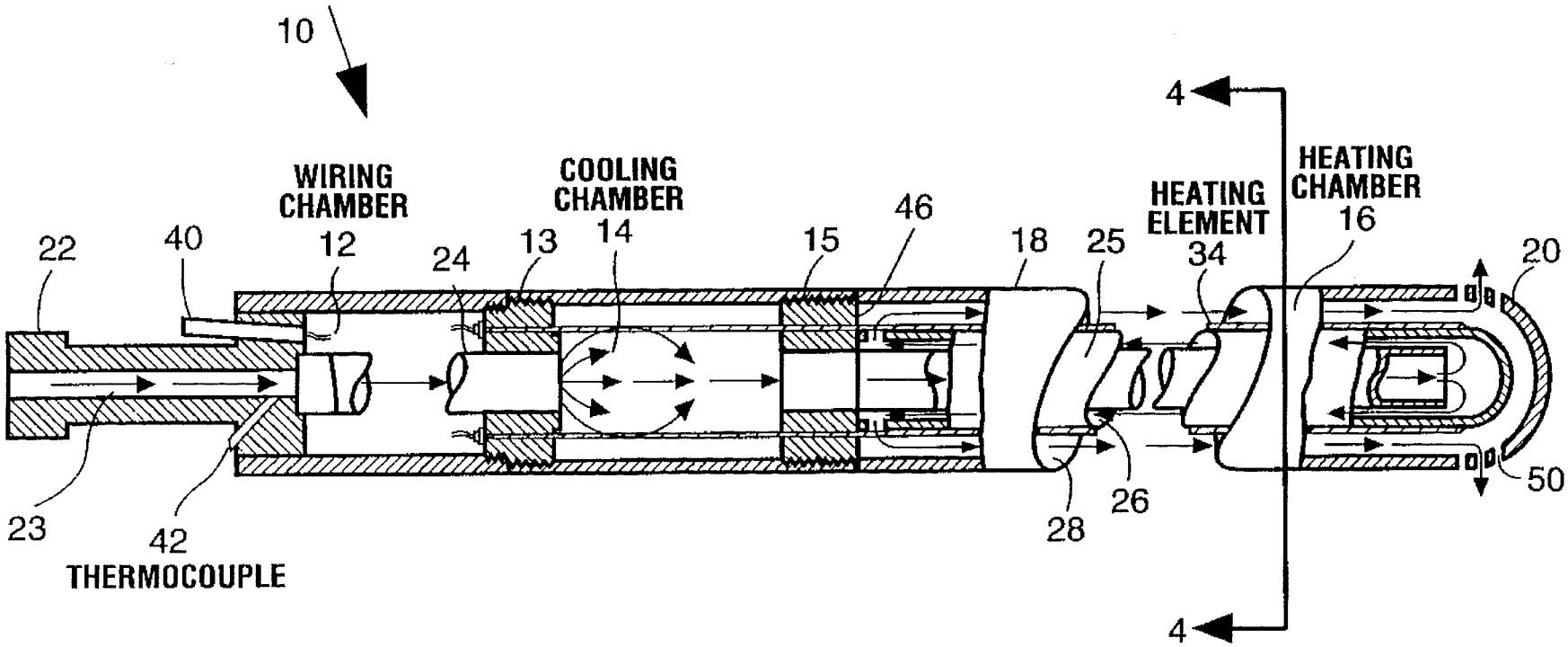
FIG. 2 illustrates a second embodiment of the heater.
Figure 4:
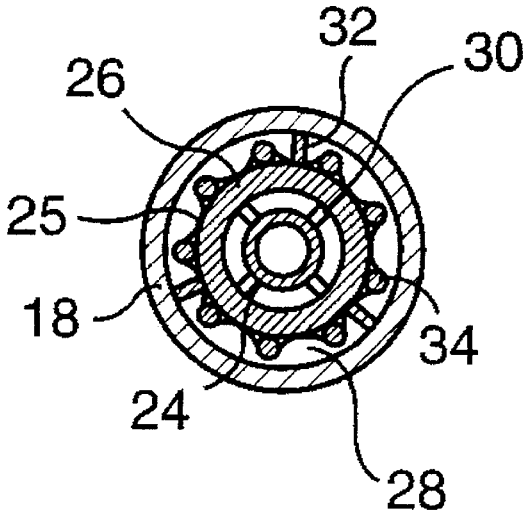
FIG. 4 is a view along lines 4—4 of FIG. 1 or 2.

Looking at FIGS. 1 and 2, there is illustrated a downhole heater 10 having a wiring chamber 12, a cooling chamber 14 and a heating chamber 16, contained in container or sleeve 18. The chambers are threaded at 13 and 15 for joining them together. The threads may be replaced with welds or the like. As clearly shown in FIG. 1, cooling chamber 14 has an upstream structure for dividing the cooling chamber from the wiring chamber 12, and a downstream structure for dividing the cooling chamber from the heating chamber. Each of the upstream and downstream structure has an aperture thereon for the gas to flow therethrough, as shown in FIG. 1. Heater 10 is closed at one end with a cap 20 and is provided with a connector 22, preferably threaded, at the opposite end, for connection with any conventional tubing means, including coiled tubing, used in the oil and gas industry. Connector 22 has a centered channel 23 extending throughout its length and emerging into pipe or tube 24, preferably made of stainless steel, which is inserted in heater 10 and extends through chamber 12 and 16, the section of pipe 24 in chamber 14 being cut and removed. Another pipe or tube 25 is inserted in chamber 16 around pipe 24, thus defining free spaces 26 and 28 between pipe 24 and pipe 25 on one hand, and pipe 25 and container 18 on the other hand. A plurality of spacer members 30 and 32 (FIG. 4) are installed to maintain the pipes 24 and 25 in place. A heat source comprising a plurality of rod-like heating element 34 are placed on the surface of pipe 25. The heating elements may he stuck, attached, welded or free.

Heating elements 34 are conventional, and can be briefly described as follows: Each comprises a first section made of two wires of nickel extending from the wiring chamber 12 through cooling chamber 14. The second section is in the heating chamber 16 and comprises two wires of INCONEL electrically connected to the wires of nickel. Both sections are contained in a casing filled with a dielectric material like magnesium oxide. The result is that little heat is generated in the cooling chamber 14 because of the nickel wires, while the INCONEL wires, which are resistive, convert electricity to heat in the heating chamber.

Each heating element 34 is inserted in a tube 31 which is connected at 35 with bolts 36 to a heater extension 38, the latter being also made of dielectric material, so that very little heat, if any, is transferred from heating chamber 16 or heating element 34 to cooling chamber 14 and wiring chamber 12. The heater extensions 38 are combined by groups of three in wiring chamber 12 to form three wires 40 which are connected to an appropriate power source (FIG. 5) at the surface.

In FIG. 2, heater extension 38 and tube 31 have been removed, since it has been found that very little heat is produced from the wires of nickel, thus rendering the used of heater extension optional. In both embodiments of FIGS. 1 and 2, it should be noted that the nickel wires extend a few inches adjacent wall 46 in the heating chamber 16 to make sure that as little heat as possible, if any, penetrates in cooling chamber 14 and wiring chamber 12.

In a preferred embodiment, a set of connectors is inserted between wires 40 and the cable connected to the power source. This set of connectors is generally located in the vicinity of the heater 10 in the wellbore. An example of such connectors is provided in U.S. Pat. No. 4,627,490.

Heater 10 is preferably equipped with a thermocouple 42 to monitor the temperature at each end of each chamber (6 occurrences).

Figure 3:
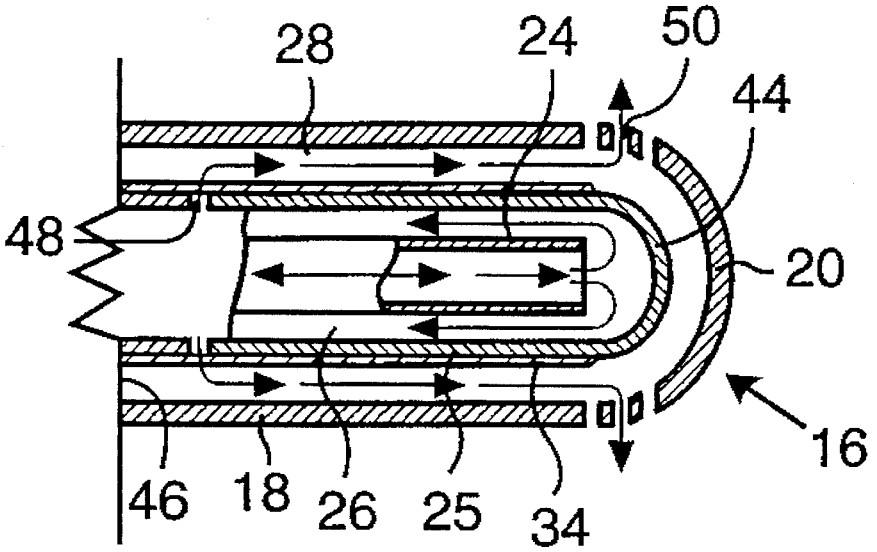
FIG. 3 is a detailed view of the heating chamber.

Looking more closely at heating chamber 16 in FIG. 3, it will be seen that pipe 25 has one end 44 closed while the other end is also closed by wall 46 adjacent cooling chamber 14. Pipe 25 comprises at least one opening 48, generally in the form of a slot. To insure that the gas is uniformly dispersed, the slots should be distributed at regular intervals at the same end around pipe 25. Container 18 also comprises at least one opening 50. Again, as for pipe 25, slots are preferred, and should be distributed around container 18 in the same manner as around pipe 25. Because of the presence of spacers 30 and 32 which maintain the pipes in place, it could also be possible to have a shorter pipe 25 which would not be in contact with wail 46, thus allowing the passage of the gas. In the same manner, cap 20 could be removed from the end of heating chamber 16, or the slots could be made in cap 20.

Figure 5:
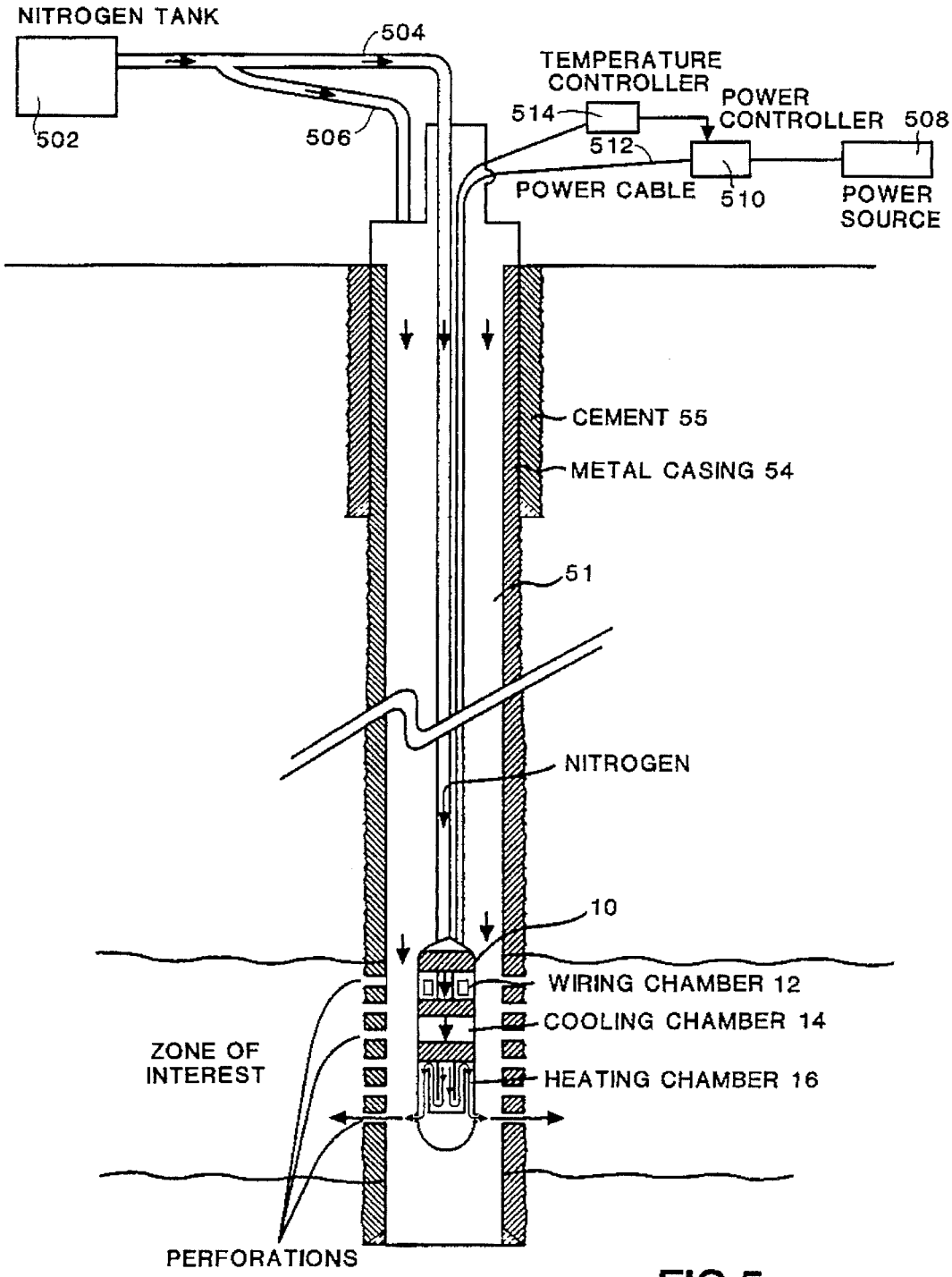
FIG. 5 is a perspective view of the present heating system in operation in a borehole.

In operation, as illustrated in FIG. 5, the heater 10 is lowered in wellbore 51 provided with a conventional internal metal casing 54, within a cement section 55. In the area of the zone of interest, heating elements 34 are heated and gas, preferably nitrogen, is injected from the surface. Generally a nitrogen tank 502 provides nitrogen through pipe 504 into pipe 24 through channel 23. Since the section of pipe 24 has been removed from cooling chamber 14, the gas is allowed to flow freely therein and act as a coolant. As the gas enters heating chamber 16 through pipe 24, its temperature starts to increase because of the presence of heating elements 34 on the surface of pipe 25. The gas follows the tortuous path indicated by the arrows before being expelled from the heater through openings 50 at the desired temperature. Such a tortuous path provides adequate residence time for the gas to heat up at the desired temperature. The ability to manipulate the gas flow rate at the surface also allows flexibility of the gas residence time within the heating chamber. It should also be noted that nitrogen is also injected from pipe 506 into casing 54 around the tubing to maintain a positive pressure downward, so that the heated gas is concentrated in the zone of interest, thus reducing the heat losses to the top of the zone (FIG. 5). As clearly shown in FIG. 5, power source 508 provides power to power controller 510, and power cable 512 supplies power to the heater 10. A temperature controller 514 controls the temperatures of the heater 10.

Each heating element has a power of 7.2 kW. In the heater herein described, nine heating elements 34 are used, therefore allowing a total power of the equipment of 65 kW. The heating elements are preferably connected by groups of three in parallel connections, so that if one group fails, the heater will still be able to operate with six elements.

Gases suitable for injection in the above heater include air, oxygen, methane, steam, inert gases and the like. Inert gases are preferred, nitrogen being the most preferred. The flow rate of gas may vary from 5 000 $m^3$/day to 57 000, or higher, $m^3$/day (standard conditions of 15° C. and 1 atm). Accordingly, a 65 kW power and a nitrogen flow rate of about 10 000 $m^3$/day would correspond to a temperature increase of up to 800° C. A temperature above 600° C. is generally sufficient for the applications of the present electric heating system. It is thus possible to control the temperature both by varying the flow rate of gas, or by regulating the power output.

Before reaching the heating chamber, the injected gas is at ambient temperature, and cools the wiring chamber and the cooling chamber, thus avoiding undesirable overheating in these chambers. The wiring chamber is also preferably fluid sealed to permit the application of the heater in any environment in the wellbore, such as water, oil, gas and mixtures therefrom. For safety, the heater should include an automatic shutoff system to cut the power off and prevent overheating of the cooling and wiring chambers.

The total length of an electric heater according to the present invention and illustrated in FIG. 1 is about 462 cm (182"), ¾ of which being the length of the heating chamber, and the wiring and cooling chamber each representing ⅛ of the length of the heater. As the diameter of deep wellbores generally does not exceed 12 cm (5"), the diameter of the heater should be around 8–9 cm (3.5") to facilitate its introduction and positioning.

The design of the electric heater of the present invention has several advantages:

if one heating element fails, the heater may still be operated at lower power; there is therefore no need to retrieve it from the wellbore;

it may be used in harsh wellbores, which contain brine, oil and gas.

All the pieces of the present heater are made of stainless steel, except for the heating elements and the heating extensions, which are sealed in INCONEL 600 sheets.

While the invention has been described in connection with specific embodiments thereof, it will be understood that it is capable of further modifications and this application is intended to cover any variations, uses or adaptations of the invention following, in general, the principles of the invention and including such departures from the present disclosure as come within known or customary practice within the art to which the invention pertains, and as may be applied to the essential features hereinbefore set forth, and as follows in the scope of the appended claims.

What is claimed is:

1. A downhole electrical heating system comprising a longitudinal heater with a container having at least one opening at one end and connecting means at the opposite end for connecting the heater to external tubing, the tubing being connected to a source of gas located at the surface, the container comprising:

a wiring chamber adjacent to the connecting means for connecting wires from an electrical power source located at the surface to at least one heating element thereby converting electrical energy to heat;

a heating chamber comprising the at least one heating element for heating a gas continuously passing through he heating chamber;

a cooling chamber inserted between the heating chamber and the wiring chamber wherein the gas is circulated therein before passing through the heating chamber, for preventing an increase of temperature in the wiring and cooling chambers, said cooling chamber having (i) upstream structure for dividing said cooling chamber from said wiring chamber and (ii) downstream structure for dividing said cooling chamber from said heating chamber, each of said upstream and downstream structure being coupled to an inside surface of said container and having an opening therein for gas to pass therethrough;

the gas following a tortuous path in the heating chamber before being released outside the heater through the at least one opening of the container.

2. A heating system according to claim 1 wherein the tortuous path is accomplished by providing a first pipe surrounding a second pipe extending coaxially in the heating chamber, the first and second pipe each having at least one opening at opposite ends, the at least one opening of the first pipe being at the same end as the at least one opening of the container.

3. A heating system according to claim 2 wherein the heating element is located on the external surface of the first pipe.

4. A heating system according to claim 1 further comprising means for monitoring the temperature in each chamber of the heater.

5. A heating system according to claim 1 wherein the gas is an inert gas.

6. A heating system according to claim 5 wherein the gas is nitrogen.

7. A heating system according to claim 1 wherein the heating element is a rod-like tube.

8. A heating system according to claim 1 wherein the wiring chamber is fluid sealed.

9. A heating system according to claim 1 wherein the power of the heater is 65 kW.

* * * * *